US005756923A

United States Patent [19]

Golden et al.

[11] Patent Number: 5,756,923

[45] Date of Patent: May 26, 1998

[54] COMPACT AUTOLOADER

[75] Inventors: Michael D. Golden, Corona del Mar; Dino K. Yu, Corona, both of Calif.

[73] Assignee: Western Design Corporation, Irvine, Calif.

[21] Appl. No.: 680,912

[22] Filed: Jul. 12, 1996

[51] Int. Cl.[6] ..... F41A 9/00

[52] U.S. Cl. ..... 89/46; 89/47

[58] Field of Search ..... 89/33.05, 33.1, 89/46, 47, 45

[56] References Cited

U.S. PATENT DOCUMENTS

| | | | |
|---|---|---|---|
| 3,241,447 | 3/1966 | Christiansson | 89/47 |
| 4,038,906 | 8/1977 | Tidstrom | 89/47 |
| 4,079,659 | 3/1978 | Gustavsson et al. | 89/46 |
| 4,640,181 | 2/1987 | Schiele et al. | 89/47 |
| 4,690,031 | 9/1987 | Metz et al. | 89/46 |
| 4,928,574 | 5/1990 | Golden | 89/34 |
| 4,947,728 | 8/1990 | Muhlhausen et al. | 89/46 |
| 5,196,643 | 3/1993 | Jorg et al. | 89/47 |
| 5,440,966 | 8/1995 | Tellander et al. | 89/47 |

*Primary Examiner*—Michael J. Carone
*Assistant Examiner*—Theresa M. Wesson
*Attorney, Agent, or Firm*—Walter A. Hackler

[57] ABSTRACT

Ammunition transfer apparatus for movement of ammunition rounds from a magazine to a gun spaced apart therefrom is provided. The apparatus includes a transfer unit for withdrawing ammunition rounds from the magazine and inserting withdrawn ammunition rounds into the gun and a reciprocating drive, disposed between the magazine and the gun, for alternatively moving the transfer unit into a first position for withdrawing ammunition rounds and a second position for inserting ammunition rounds. In addition a carrier is attached to the reciprocating drive, for causing up to approximately a 180° rotation of the transfer unit between the first and second positions.

26 Claims, 15 Drawing Sheets

FIG. 13.
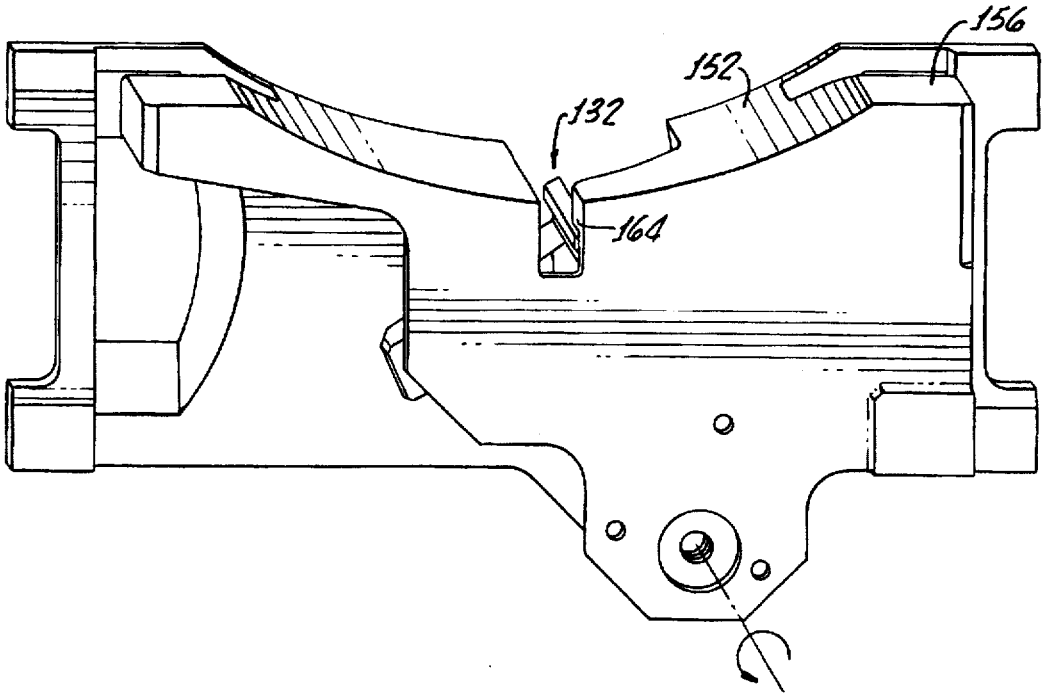
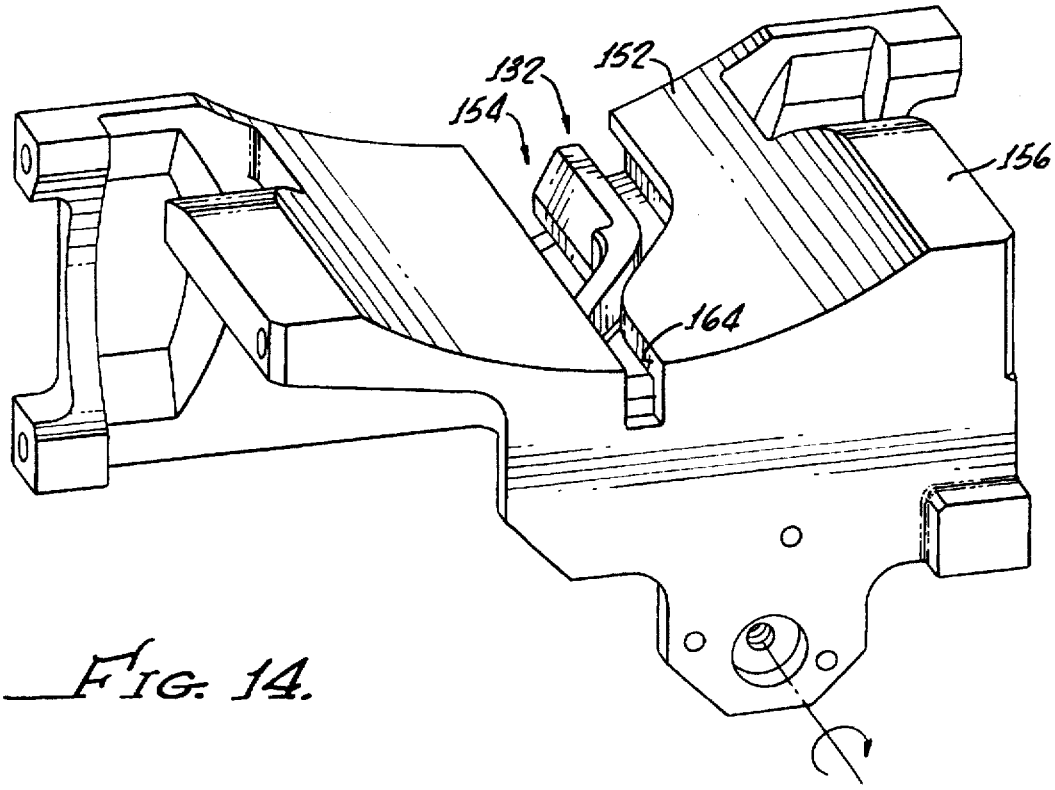
FIG. 14.

COMPACT AUTOLOADER

The present invention relates generally to ammunition handling apparatus, that is more particularly directed to ammunition transfer apparatus for movement of ammunition rounds from a magazine to a gun.

The present invention has a particular advantage in handling ammunition within a limited envelope, as for example, between and ammunition magazine and a gun mounted on a combat vehicle such as a tank.

Heretofore, transfer of ammunition within a tank was typically done manually. However, modern rapid firing guns naturally require rapid insertion of ammunition rounds, which, in the case of large caliber weapons, such as 120 mm, makes manual handling of the ammunition (weighing 25 Kg or more), a difficult assignment.

As set forth in U.S. Pat. No. 4,928,574 ammunition magazine systems have been developed for compact storage ammunition in a combat vehicle. However, the magazines are spaced apart from the gun and little space is available, including overhead space, for the automatic loading equipment. Ammunition handling in this envelope is further complicated in that it is preferable that ammunition rounds are not stored in the magazine in an orientation with the projectile end of the rounds facing the gun or personal for obvious reasons. Hence, inversion of ammunition rounds during transfer from the magazine to the gun is desirable in order to allow rounds to be stored with the projectile end pointed aft of the tank. This orientation greatly enhances vehicle survivability in the event of an ammo bunker penetration.

The present invention provides for such automatic loading equipment.

SUMMARY OF THE INVENTION

Ammunition transfer apparatus for the movement of the ammunition rounds from a magazine to a gun in accordance with the present invention generally include transfer means for withdrawing ammunition rounds from a magazine, inverting a withdrawn ammunition round, end for end, and inserting the inverted withdrawn ammunition round into a gun.

In combination therewith, reciprocating drive means is provided and disposed between the magazine and the gun for alternately moving the transfer means into a first position for withdrawing ammunition round from a magazine and a second position for inserting inverted withdrawn ammunition rounds into the gun.

More particularly, the transfer means may include a transfer unit and carrier means attached to the reciprocating drive means causing pivotal movement of the transfer unit during movement of the transfer means between the first and second positions.

When the stored ammunition rounds within a magazine are generally aligned with a longitudinal axis of the gun and gun chamber, the carrier means causes up to approximately a 180° rotation of the transfer unit between the first and second positions.

Transfer unit may include a housing and/or rammer means may be provided and disposed for a reciprocal movement along the transfer unit within the housing for moving ammunition rounds into and out of the transfer unit.

Rammer drive means are provided and disposed in the transfer unit for reciprocating the rammer means. The rammer drive means may include sprockets disposed proximate ends of the transfer unit housing and a chain interlinking opposing sprockets. In addition, the extractor means may include cam means for causing the radial movement of the plurality of dogs with a cam means including a pawl for engagement with a slot in the housing, with the slot guiding the pawl and accordingly causing radial movement of the dogs in response to linear movement of the rammer and extractor means.

Withdrawal of ammunition rounds from the magazine is facilitated by extractor means for temporarily gripping an ammunition round base. Release of the ammunition round by the extractor occurs just prior to completion of insertion of the inverted withdrawn ammunition round into the gun chamber. This routine provides for time saving since the rammer means can complete a stroke and immediately retract with out having to wait for the extractors to open.

More particularly, the extractor means may include a plurality of dogs disposed for radial movement with respect to a longitudinal axis of the transfer unit and further means is provided for causing radial movement of the plurality of dogs in response to linear movement of the rammer means along the transfer unit.

Importantly, case rider means are provided and attached to the rammer drive means chain at a spaced apart distance from the extractor means for maintaining alignment of an ammunition round being inserted into the gun within a gun chamber.

The reciprocating drive means for the transfer unit includes a chain means for moving the transfer unit in reciprocating directions generally perpendicular to longitudinal axis of the gun. The carrier means may include an elevation frame engaging the chain means and the transfer unit means. Incorporated in the carrier means are pivot motor means for rotating the transfer unit means during movement from the first to the second positions. In this manner an end to end inversion of the ammunition is effected during this movement from a storage position within the magazine to a firing position within the gun chamber.

BRIEF DESCRIPTION OF THE DRAWINGS

A better understanding of the present invention may be had of the consideration of the following detailed description, taken in conjunction with the accompanying drawings in which:

FIG. 13 is a perspective view of the housing end showing the position of the tic toc mechanism for closure of the extracted dogs; and FIG. 14 is a view similar to FIG. 13 showing the tic toc in a position for opening the extractor dogs for release of ammunition.

DETAILED DESCRIPTION

Figure 1:
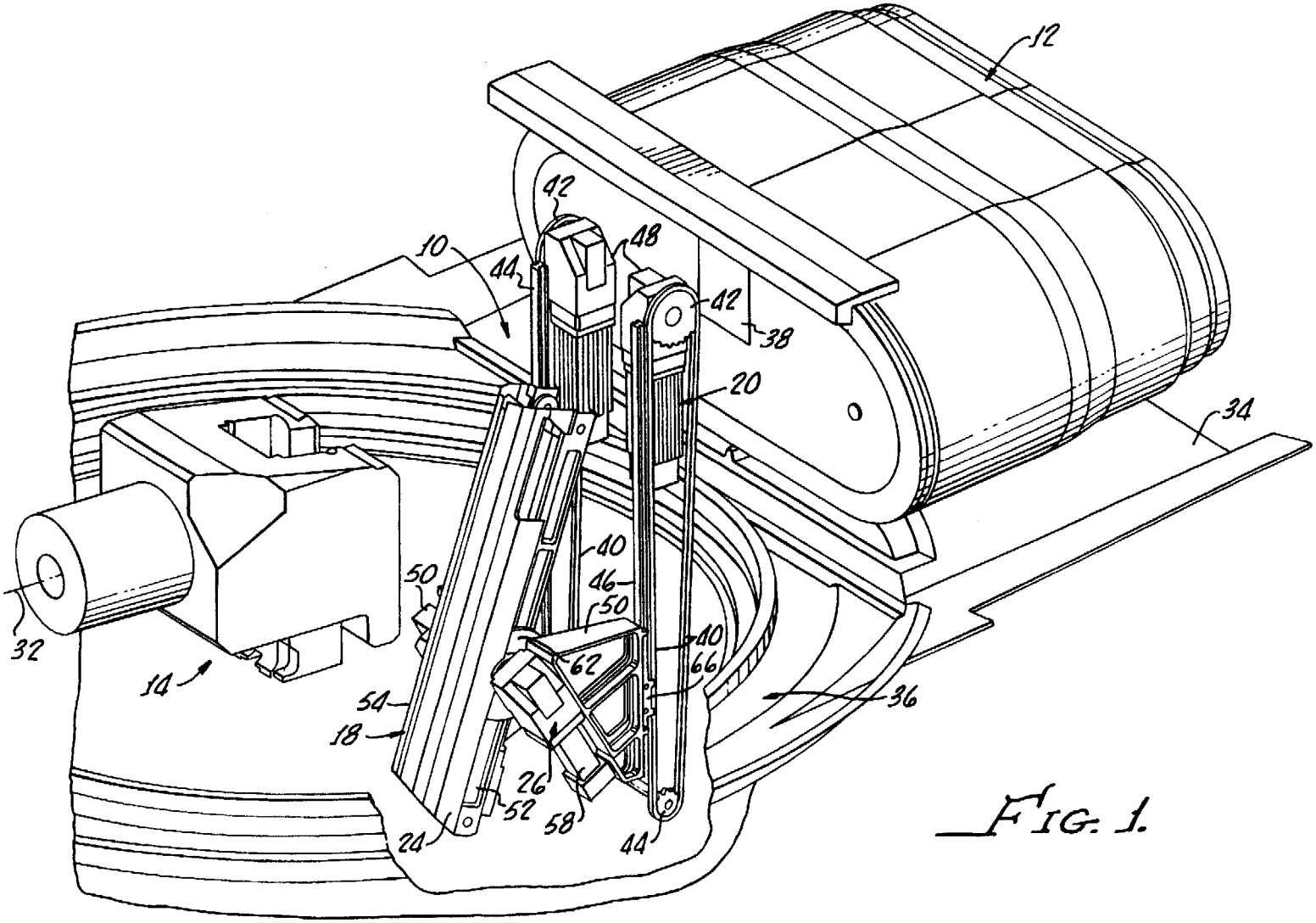
FIG. 1 is a perspective view of a compact autoloader or ammunition transfer apparatus in accordance with the present invention, shown as it may be installed between a magazine and a gun which may be disposed on a combat vehicle, such as a tank, not shown.

Turning now to FIG. 1, there is shown ammunition transfer apparatus 10 in accordance with the present invention for moving ammunition rounds (not shown in FIG. 1) from a magazine 12 to a gun 14, and more particularly transfer means 18 for withdrawing ammunition rounds from the magazine 12, inverting a withdrawn ammunition round end to end, and inserting inverted withdrawn ammunition rounds into the gun 14, as herein described in greater detail.

Figure 2:
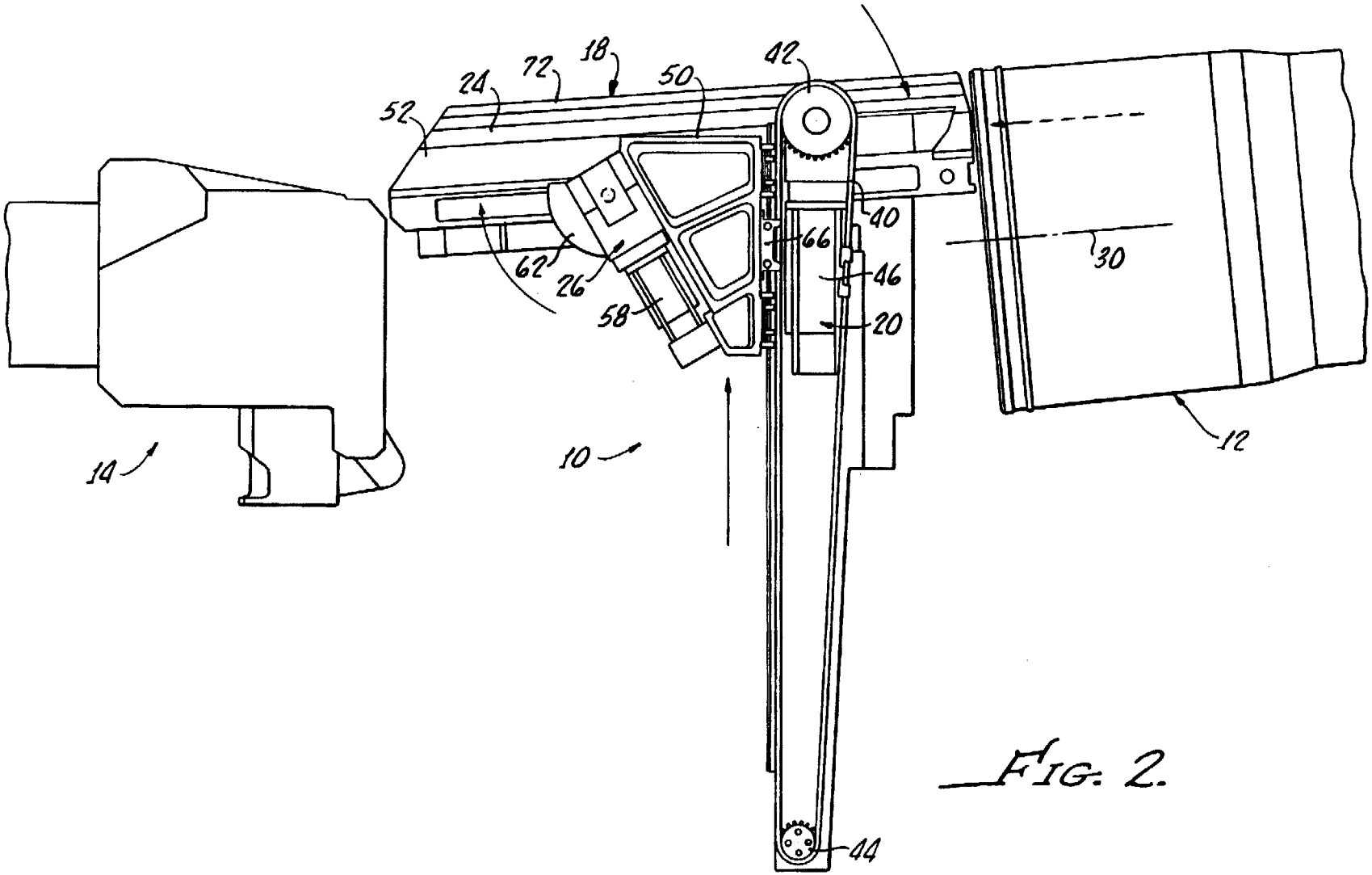
FIG. 2 is a side view of the transfer apparatus position for withdrawing an ammunition round from the magazine.
Figure 3:
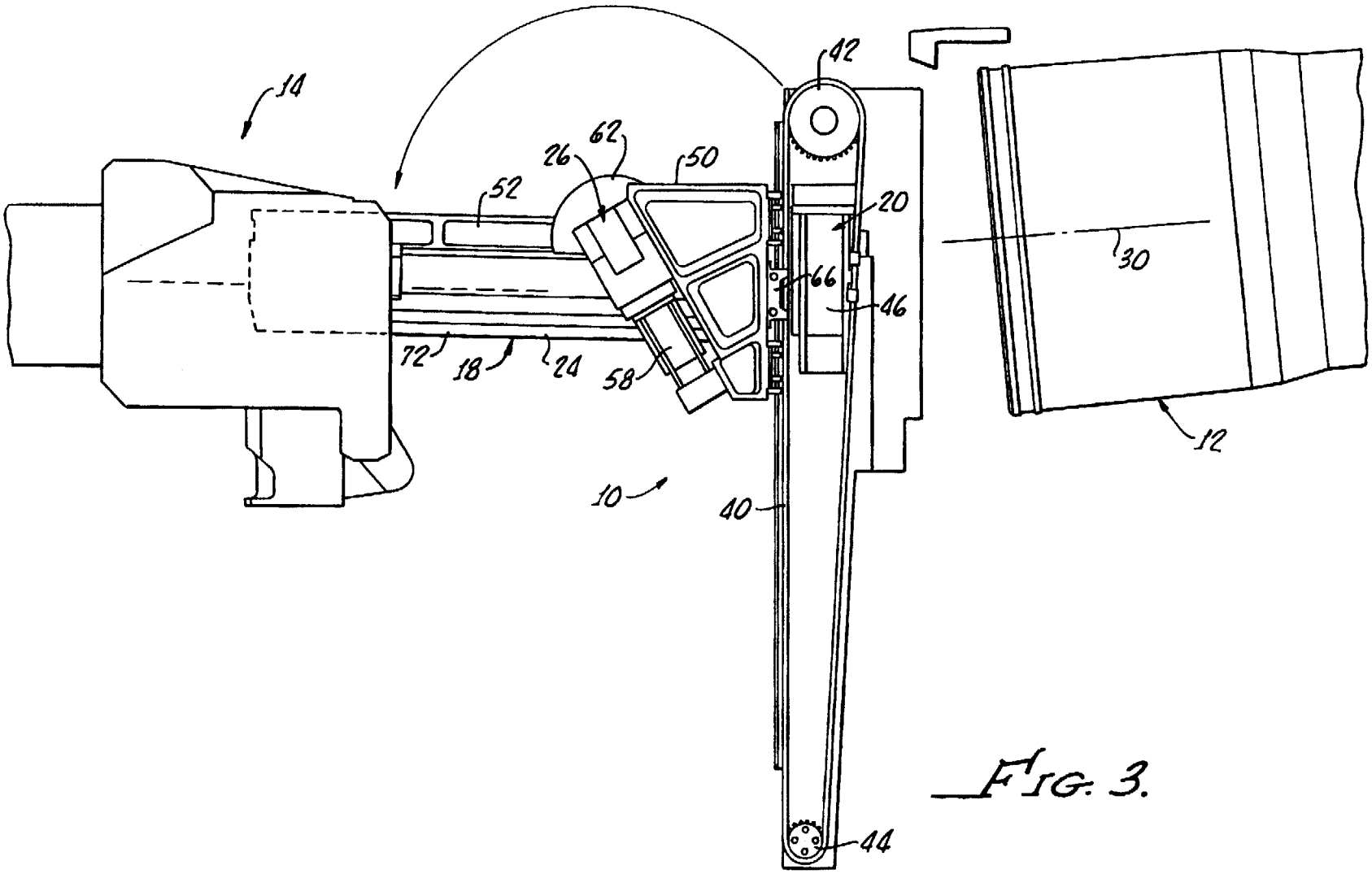
FIG. 3 is a side view of the transfer apparatus at a position for inserting a withdrawn inverted ammunition round into a gun chamber.

Also shown is a reciprocating elevation drive means 20 disposed between the magazine 12 and the gun 14 for alternately moving the transfer means 18 into a first position for withdrawing ammunition rounds from the magazine (see FIG. 2) and a second position for inserting inverted withdrawn ammunition rounds into the gun 14 (see FIG. 3). More particularly, the transfer means 18 includes a transfer unit 24 which provides a means for withdrawing ammunition rounds from the magazine 12 and inserting withdrawn ammunition rounds into the gun 14 and a carrier 26 which is attached to the reciprocating elevation drive means 20 and the transfer unit 24 for causing up to approximately a 180° rotation of the transfer unit 24 between the first and the second positions as shown respectively in FIGS. 2 and 3.

Figure 3A:
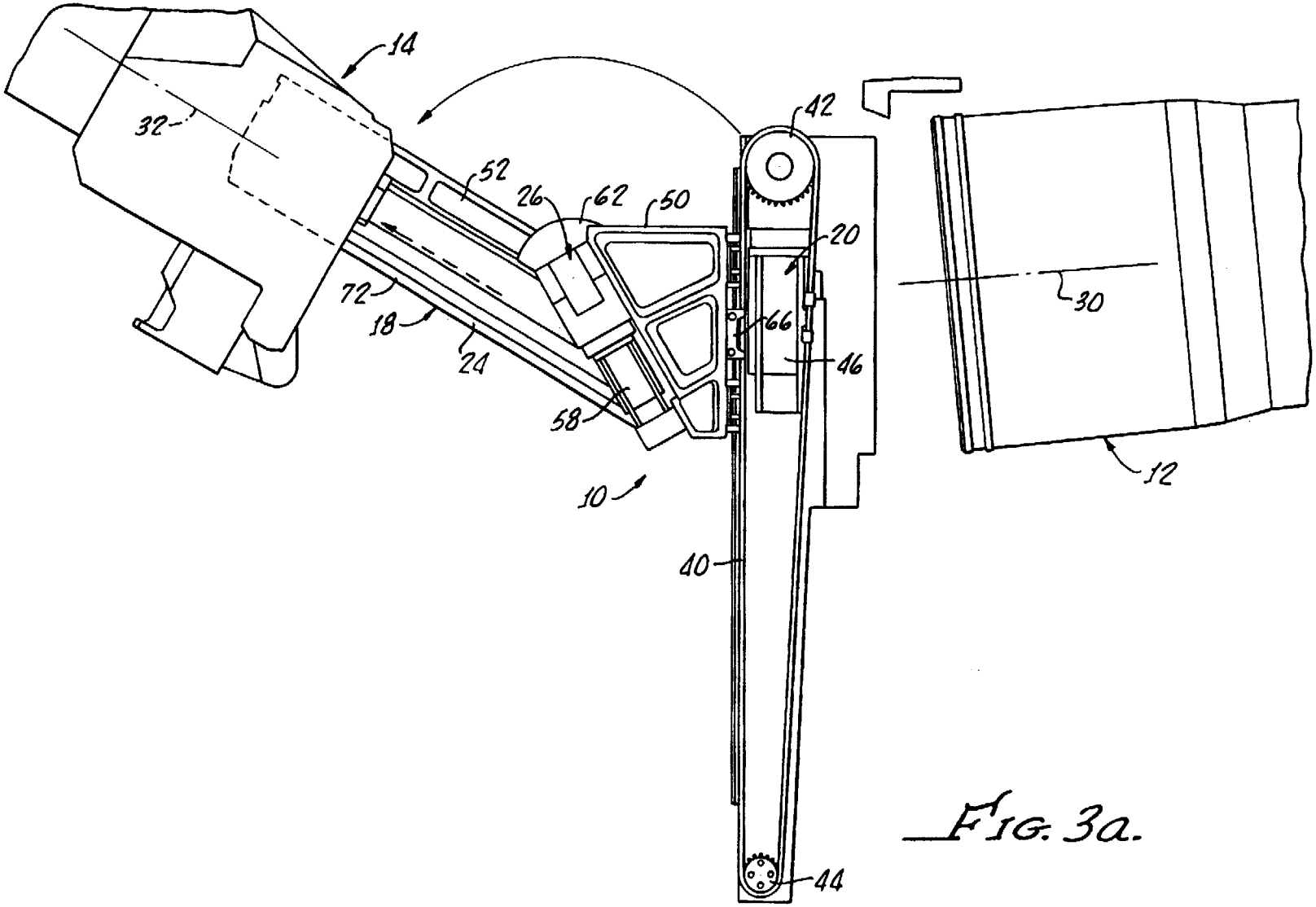
FIG. 3*a* is a side view of the transfer apparatus at a position for inserting a withdrawn inverted ammunition round into a gun chamber with the gun at an elevation angle with respect to the magazine and horizontal.

Importantly, the transfer unit 24 due to its elevational movement by the drive means 20 is operational for withdrawing ammunition from various spaced apart points or compartments of the magazine 12 and inserting the withdrawn ammunition rounds into the gun while the gun is at various elevations for commencement of fire, see FIG. 3*a*. This enhances the effective firing rate of the gun since a return to horizontal is not necessary for reloading thereof.

The reciprocating drive means also provides for enabling access to the magazine 12 and the gun 14 at different elevations as shown by comparing the side views shown in FIGS. 2 and 3. However, it should be appreciated that, in general, a longitudinal axis 30 of the magazine may coincide with the longitudinal axis of the gun 32 or alternatively, as shown in the FIG. 3*a*, the longitudinal axes 30, 32 may be at an angle with one another.

However, it is to be appreciated that while the axes 30, 32 may not be parallel accommodation for any angular relationship therebetween can be accommodated by the transfer apparatus 18 in accordance with the present invention. Reference Figures herein are presented for illustration purposes only and other orientations are to be considered within the scope of the present invention.

In view of the physical constraints imposed by the spaced apart relationship between the magazine 12 and the gun 14 in which the magazine may be mounted to a tank frame 34 and the gun mounted to the turret 36, it is preferred that the drive means 20 be mounted for reciprocating the transfer unit 24 in directions generally perpendicular to the longitudinal axes 30, 32 as shown in the FIG. 3. It must also be appreciated that overhead constraints are also imposed because of a turret top (not shown) enclosing the apparatus 10.

The magazine 12 may be any suitable type such as, for example, described in U.S. Pat. No. 4,928,574 for storing and transferring ammunition to a port 38 which provides a means for accessing ammunition rounds from the magazine 12 in which a longitudinal axis of the ammunition rounds (not shown) coincides with or is generally parallel with the longitudinal axis 32 of the gun. U.S. Pat. No. 4,928,574 is to be incorporated herewith, in toto, in order to fully describe a magazine suitable for use with the present invention.

The reciprocating elevation drive means 20 may comprise of chains 40, drive sprockets 42 and idler sprockets 44 held in a spaced apart relationship by a frame 46 and driven by motors 48 in order to move the transfer unit 24 in reciprocating directions which are generally perpendicular to the longitudinal axis 32 of the gun 14.

Figure 4:
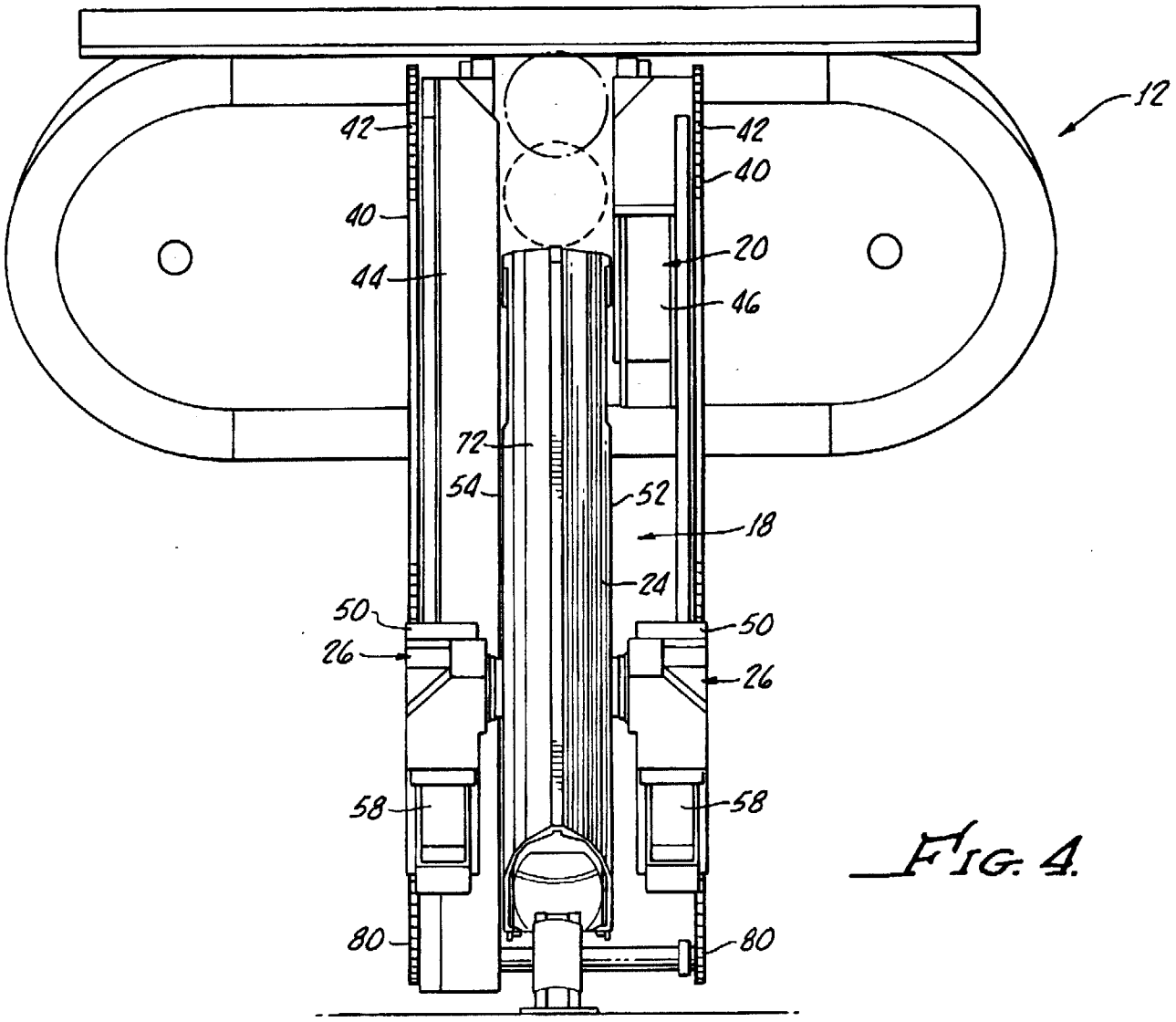
FIG. 4 is a front view of the transfer apparatus shown at the stow position.

As shown, the carrier 26 includes elevation frames 50 disposed on two sides 52, 54 of the transfer unit 24, see also FIG. 4.

Figure 5:
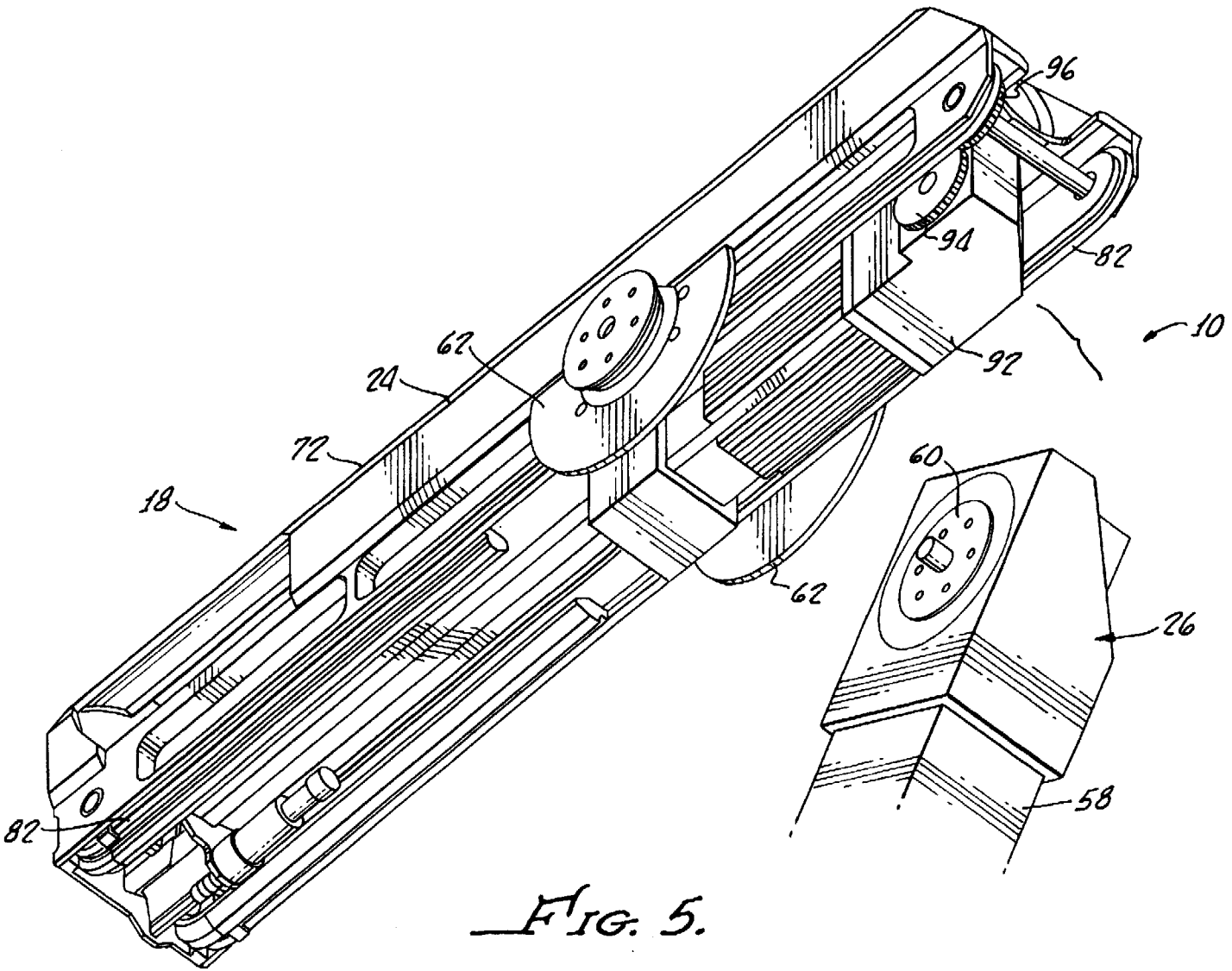
FIG. 5 is a perspective view of a transfer unit in accordance with the present invention spaced apart from a carrier for engaging flanges for rotating the transfer unit.

As more clearly shown in FIG. 5, the carrier 26 includes a pivot motor 58 including a drive shaft 60 coupled to a flange 62 in a conventional manner for rotating the transfer unit 24 during movement from the first to the second position.

It should also be appreciated that in combination with the elevation motors 46 and pivot motors 58 elevation, resolvers (not shown) are preferably provided in order to provide data relating to the exact position and orientation of the transfer unit to a control system, not shown.

The control system may be of any suitable electronic/computer programmable system for coordinating movement and control of not only the transfer apparatus 10 but the magazine 12 for providing various different rounds of ammunition at a specific time and for firing of the gun.

Figure 6:
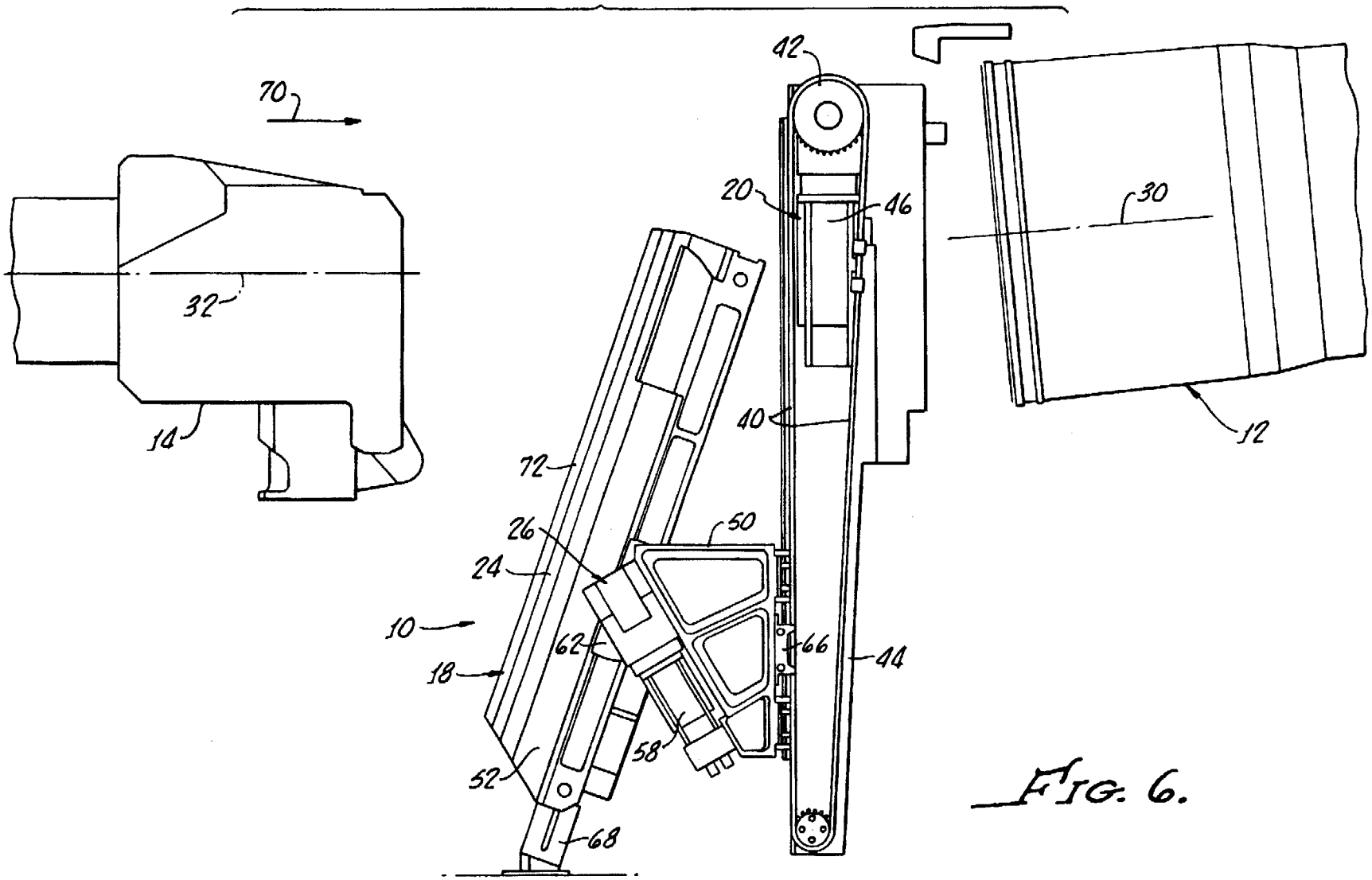
FIG. 6 is a side view of the transfer apparatus shown in a stow position between a magazine and a gun.

As shown in FIG. 6, firing of the gun is done with the transfer apparatus 10 in a stowed position proximate a mount 68 in order to provide room for gun 14 recoil as indicated by the arrow 70 in FIG. 6. Thus, despite the small working envelope provided between the gun 14 and the magazine 12 and necessary allowance for gun 14 recoil, transfer apparatus 10 in accordance with the present invention provides for selectively withdrawing a ammunition round (not shown) from magazine 12, inverting the ammunition round and inserting same into the gun 14 with no inhibition to the recoil movement of the gun 14 during firing. The mount 68 also serves to support the transfer means 18 during non-use thereof when electrical operating power thereto may be shut off.

Figure 7:
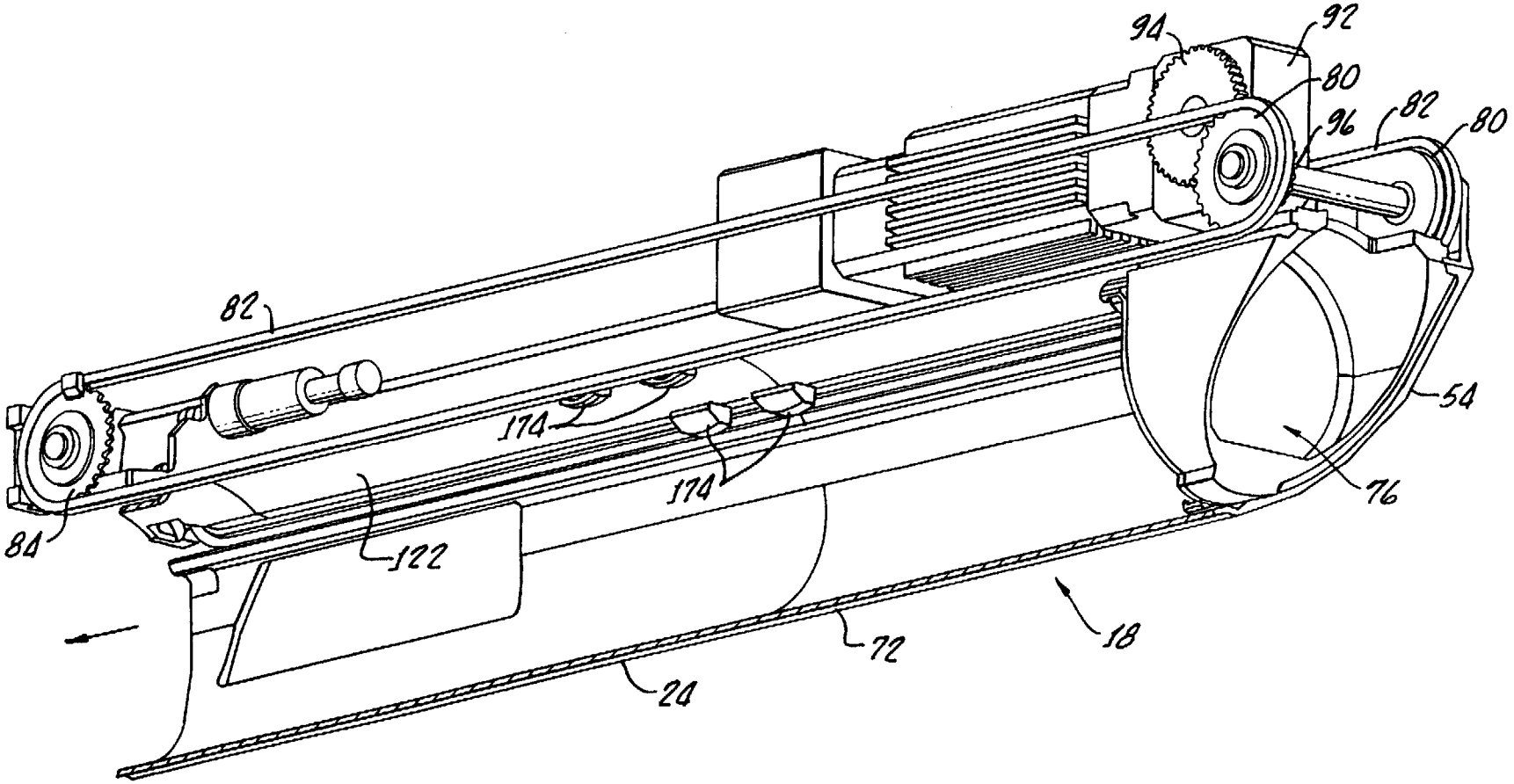
FIG. 7 is perspective view of an opposite side of the transfer unit generally showing a rammer for movement of ammunition rounds within the transfer unit and case riders for maintaining alignment of the ammunition round as it is inserted into the gun chamber.
Figure 8:
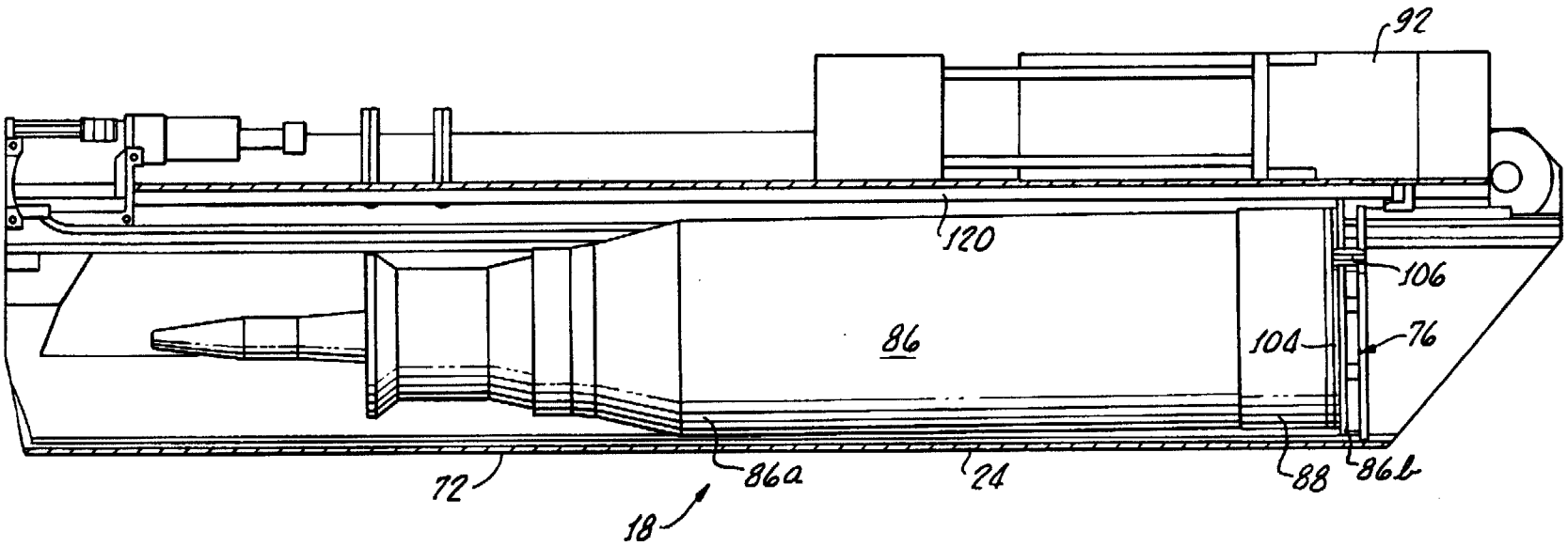
FIG. 8 is a cross-sectional side view of the transfer unit with an ammunition round disposed therein.

Turning now to FIGS. 7 and 8 there is shown within a transfer unit housing a rammer 76 which is disposed for movement along and within housing 72 by means of drives sprockets 80 and chains 82 and idler sprockets 84 for moving ammunition rounds into and out of the transfer unit 24. Attachment of the rammer 76 to the chains 82 in any conventional manner provides for reciprocal motion of the rammer 76 within the transfer unit housing 72 during pick up of ammunition from the magazine 12 and delivery and insertion of the ammunition into the gun 14.

FIG. 8 shows a typical ammunition round 86 is shown within the transfer unit housing 72 held at a base 88 by an extractor 106 which provides means for temporarily griping the ammunition round 86 in order to withdraw the ammunition round 86 from the magazine 12.

The movement of the rammer 76 via the chain 82 is provided by a rammer motor 92 and are connected by gears 94, 96 and sprocket 86. Operation of the motor 92 including reversible action thereof as well as control and direction of the pivot motor and motors 46 (see FIG. 6) for elevational movement of transfer unit 24 are all coordinated by a properly programmed control system (not shown) suitable for coordinating required movements of the transfer apparatus 10.

Figure 9:
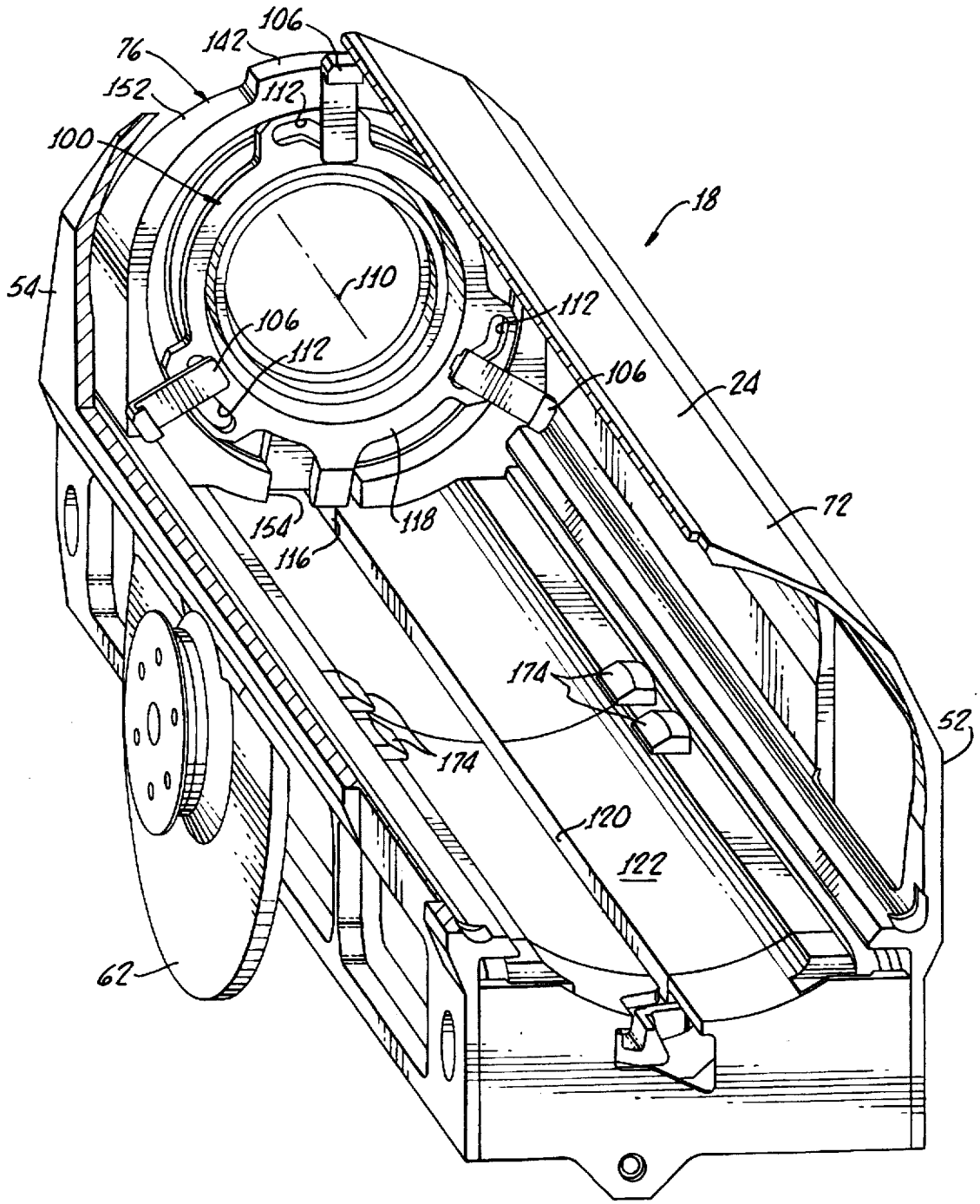
FIG. 9 is a partially broken away perspective view of the transfer unit showing an extractor having three dogs for engaging a base of an ammunition round.
Figure 10:
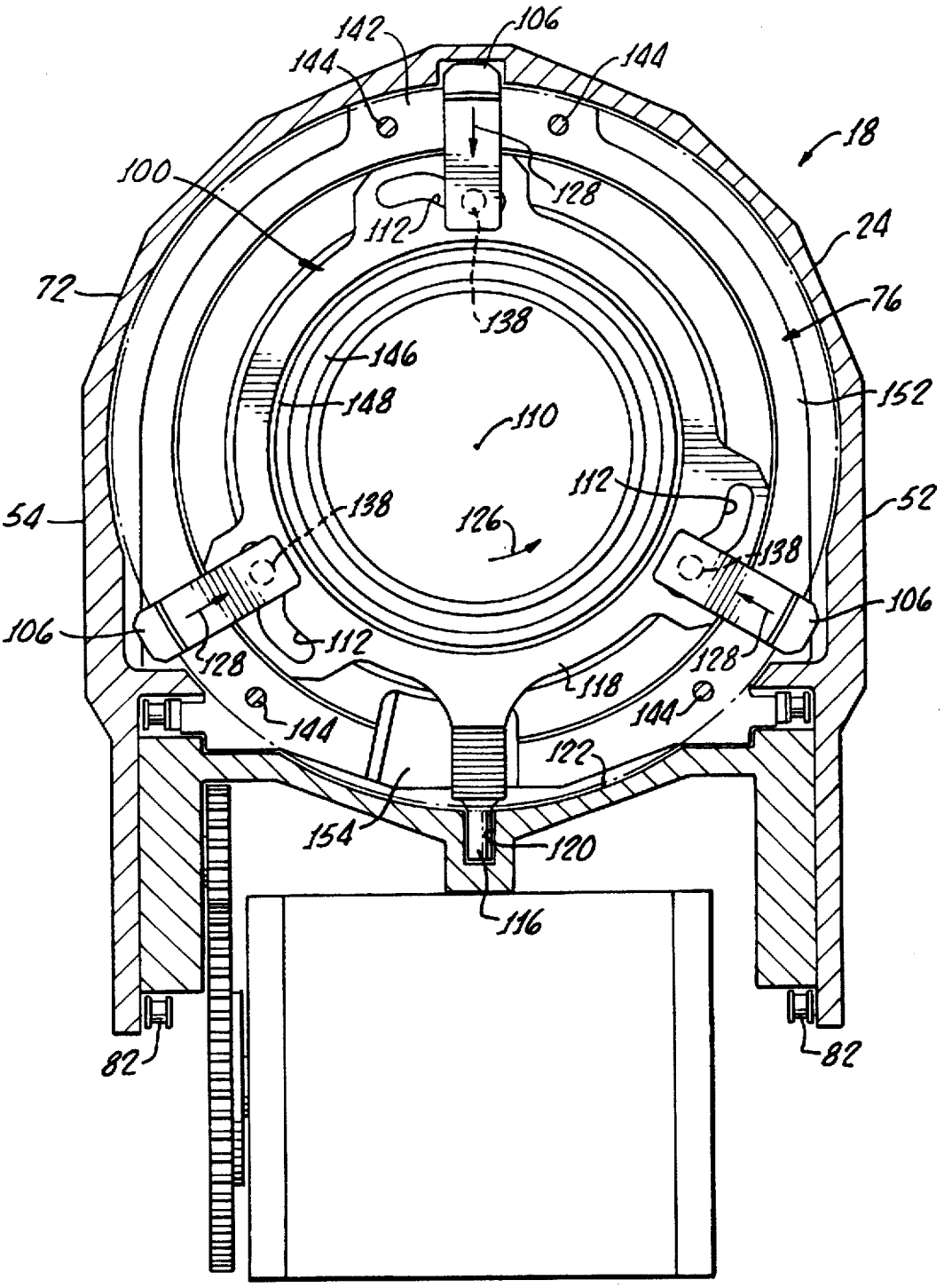
FIG. 10 is a cross-sectional view of the transfer unit showing an opposite side of the extractor, a cam and a pawl, for engaging a slot in the transfer unit housing for operation of the extractor, the view being shown with extractor dogs in a closed position.

As shown in FIGS. 9 and 10 an extractor 100 provides a means for temporarily gripping ammunition on base 88 by a groove 104 (FIG. 8) for withdrawing the ammunition round 86 of the magazine 12. Included in the extractor are a plurality of dogs 106 which are disposed for radial movement with respect to a longitudinal axes 110 of the transfer unit, within slots 112 which provide the cam means for causing the radial movement of the dogs 106 in response to linear movement of the rammer 76 and extractor 106 along the housing 72.

This movement is provided by a pawl 116 integrally extending from a cam plate 118 which is guided by a slot 120 in a housing body 122.

It should be obvious from FIGS. 9 and 10 in a clockwise rotation of the template 118 as indicated by the arrow 126 causes the dogs 106 to follow in the slots 112 to cause closure of the dogs 106 as indicated by the arrows 128.

Conversely, counter clockwise rotation of the template 118 moves the dogs readily outward thus freeing any ammunition round thereby.

Clockwise and anti-clockwise movement of cam plate 118 is affected through a tic toc mechanism 132 shown in FIGS. 11–14. As most clearly shown in the exploded view of FIG. 12, the dogs 106 are slidably mounted in an extractor plate 134 and include ends 138 for engaging slots 112 in the cam plate 118. Extractor 100 is mounted to a front plate 142 on the rammer 76 by means of screws 144. A spring 146 disposed within a spring sleeve 148 enable support of the ammunition round 86 in an elevated gun 14 during release of the dogs 106 and before engagement of retainers, not shown, in the gun chamber to prevent rearward movement of the ammunition round 86 due to gravity.

The tic toc mechanism 132 is pivotably mounted within a housing base 152 within a forward opening 154 and pivoted therein by means of a motor 158. A potentiometer 160 provides a signal to the control system (not shown) regarding the position of the tic toc 132 within the opening 154.

The forward base 152 includes an entry slot 164 aligned with the slot 120 for smooth movement of the pawl 116 therein.

Figure 11:
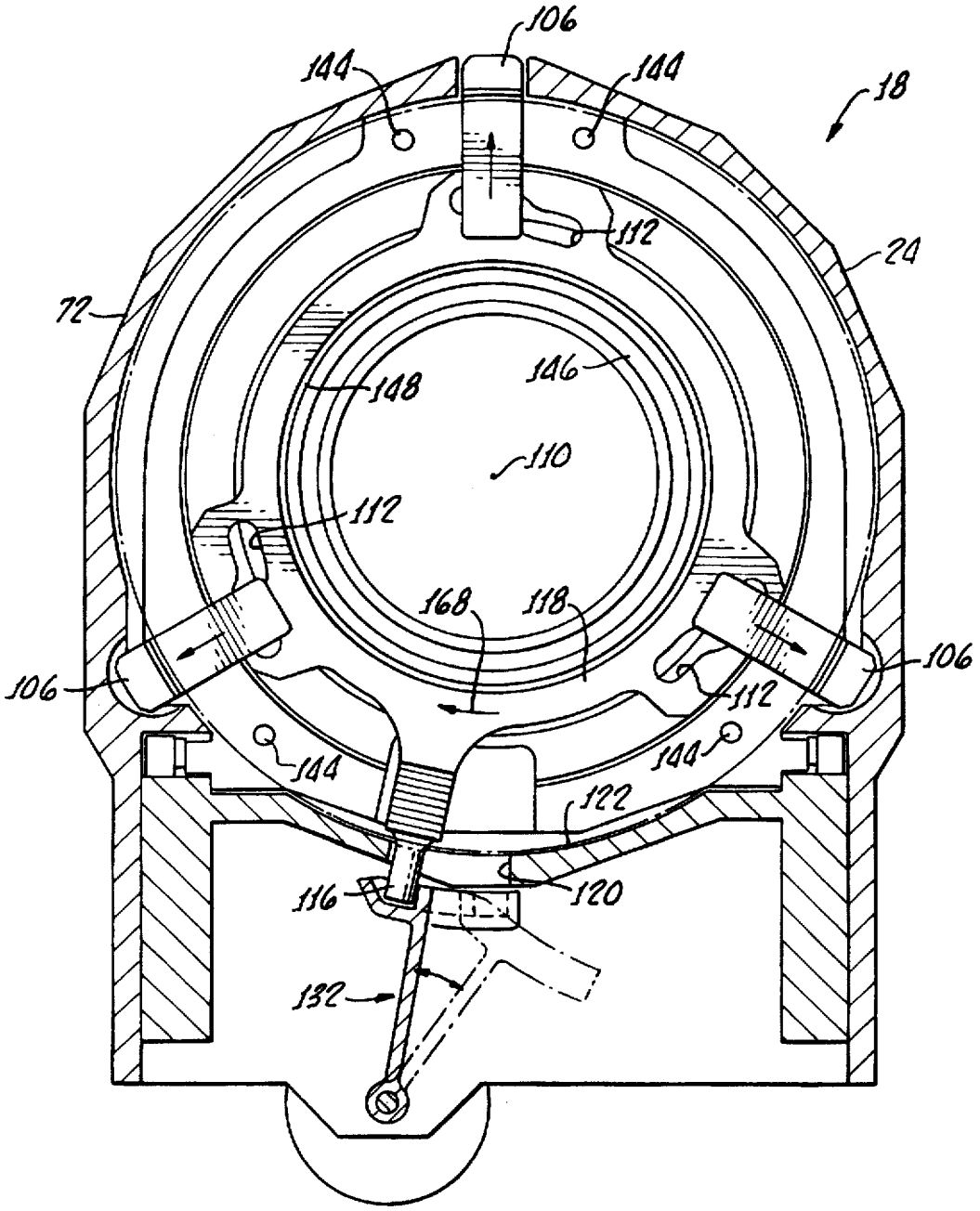
FIG. 11 is a view similar to FIG. 10 showing opened and closed positions of the extractor, the view being shown with extractor dogs in an open position.
Figure 12:
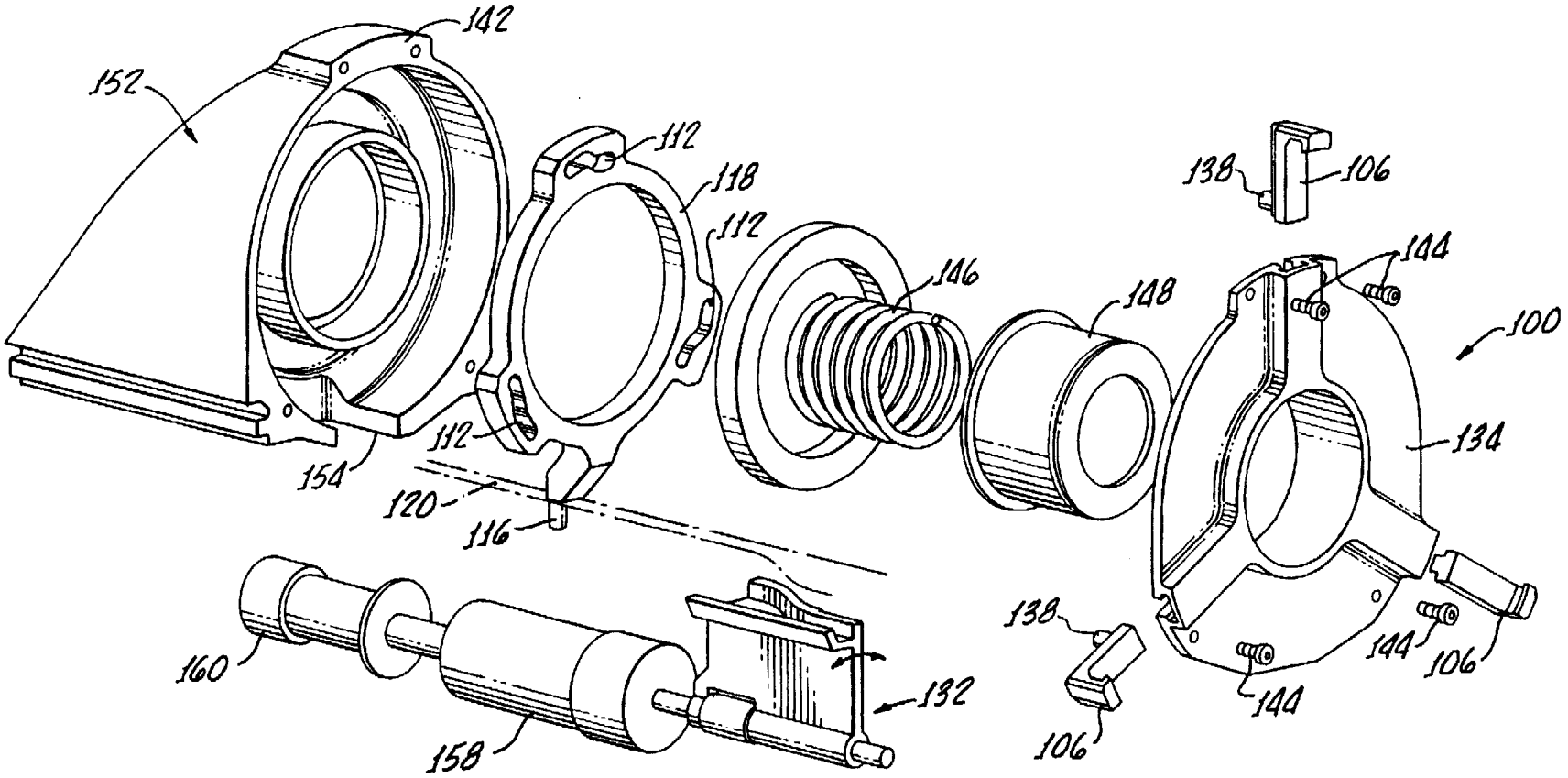
FIG. 12 is an exploded view of the extractor and a tic toc mechanism for controlling movement of the extractor dogs.
Figure 15A:
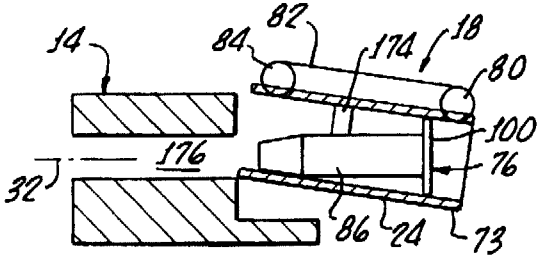
FIGS. 15*a*–15*f* are stage wise depictions of the transfer unit inserting an ammunition round into a gun chamber and the function of the case riders for maintaining alignment.
Figure 15B:
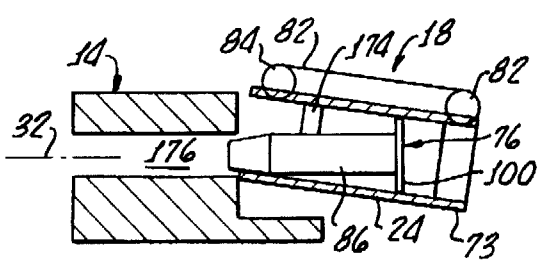
Figure 15C:
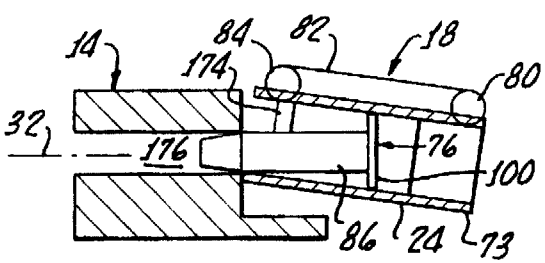
Figure 15D:
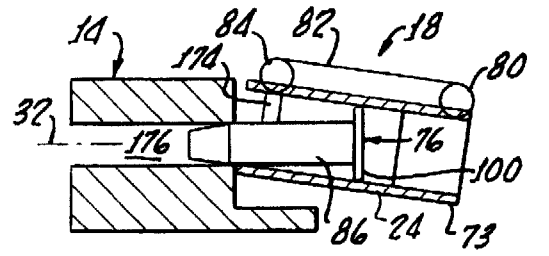
Figure 15E:
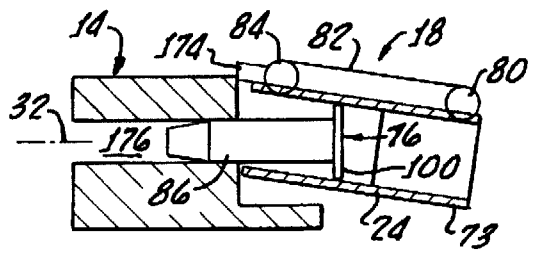
Figure 15F:
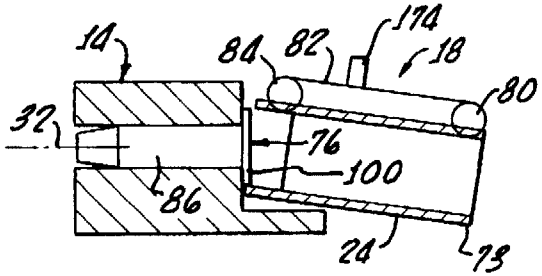

As shown in FIG. 13 when the motor 158 rotates the tic toc 132 in a counter clockwise position a path is provided for moving the pawl 116 to cause counter clockwise rotation of the cam plate 118 in a clockwise direction, shown by the arrow 168 in FIG. 11 which causes the dogs 106 to move readily inward to grip ammunition round during insertion of the round into the gun 14.

When the motor 158 rotates the tic toc 132 in a clockwise direction, as shown in FIG. 14, the pawl 116 is moved in a clockwise direction causing the dogs to move outward as the rammer 76 the ammunition round via the groove 104 for enabling withdraw of the ammunition round 86 from the magazine 12.

Another important aspect of the present invention is shown in FIGS. 7 through 9 and illustrated in FIGS. **15*a*–15*f*. As shown case riders 174 attach to the rammer drive chain 82 at a spaced apart distance from the extractor 100 provides a means for maintaining an alignment of the ammunition round 86 inserted into the gun 14 within a gun chamber 176. Such alignment is important in order to prevent jamming of the ammunition round 86 as it is forced into the gun chamber 176 by the rammer 76. The case riders 174 physically control movement a forward case portion 86*a* which is significantly smaller in diameter than a case rim 86*b* and withdraw from contact therewith via movement of the chains 82 to enable the case rim 86*b* to enter the gun chamber 176. The taper is more clearly seen in FIG. 8**.

As shown, the transfer unit housing 72 is at an inclined attitude with respect to the longitudinal axis 32 and accordingly upward movement of the ammunition round 86 may cause misalignment with gun chamber 176. It is to be appreciated that the diagram shown in FIGS. **15*a*–15*f* is greatly exaggerated only to emphasize the function of the case riders 174 in stabilizing and guiding the ammunition round 86 into the gun chamber 176**.

As shown during insertion of the ammunition round 86 by forward movement of the rammer 176, the transfer unit housing 73 lowers in elevation also maintaining, in combination with the cam riders 174, alignment of the ammunition round 86 with the gun chamber 176.

Although there has been hereinabove described a specific compact auto loader or ammunition transfer apparatus in accordance with the present invention for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the invention as defined in the appended claims.

What is claimed is:

1. Ammunition transfer apparatus for movement of ammunition rounds from a magazine to a gun spaced apart therefrom, the apparatus comprising:

transfer unit means for withdrawing ammunition rounds from said magazine and inserting withdrawn ammunition rounds into said gun;

reciprocating drive means, disposed between said magazine and said gun, for alternatively moving said transfer unit means into a first position for withdrawing ammunition rounds and a second position for inserting ammunition rounds; and carrier means, attached to said reciprocating drive means, for causing up to approximately a 18020 rotation of said transfer unit means between the first and second positions.

2. The ammunition transfer apparatus according to claim 1 wherein said drive means is disposed for moving said transfer unit means in reciprocating directions generally perpendicular to a longitudinal axis of said magazine.

3. The ammunition transfer apparatus according to claim 1 said transfer unit means is movably disposed along said reciprocating drive means and pivotally connected to said carrier means for enabling withdrawal of ammunition from said magazine at spaced apart positions and for inserting withdrawn ammunition into said gun when said gun is elevated or depressed at an angle to the longitudinal axis of said magazine and horizontal.

4. The ammunition transfer apparatus according to claim 1 further comprising rammer means, disposed for reciprocal movement along said transfer unit means, for moving ammunition rounds into and out of said transfer unit means.

5. The ammunition transfer apparatus according to claim 4 wherein said rammer means includes extractor means for temporarily gripping an ammunition round base in order to withdraw the ammunition round from said magazine.

6. The ammunition transfer apparatus according to claim 5 wherein said extractor means comprises a plurality of dogs disposed for radial movement with respect to a longitudinal axis of said transfer unit means, and means for causing radial movement of said plurality of dogs in response to linear movement of said rammer means along said transfer unit means.

7. The communication transfer apparatus according to claim 1 wherein said reciprocating drive means comprises chain means for moving the transfer unit means in reciprocating directions generally perpendicular to a longitudinal axis of the gun.

8. The ammunition transfer apparatus according to claim 7 wherein said carrier means includes an elevation frame engaging said chain means and said transfer unit means.

9. The ammunition transfer apparatus according to claim 8 wherein said elevation frame includes pivot motor means for rotating said transfer unit means during movement from the first to the second position.

10. The ammunition transfer apparatus according to claim 6 further comprising rammer drive means, disposed in said transfer unit means, for reciprocating said rammer means.

11. The ammunition transfer apparatus according to claim 10 wherein said rammer drive means comprises a motor driven chain and sprocket.

12. The ammunition transfer apparatus according to claim 11 wherein said transfer unit means comprises housing means for supporting said rammer means and rammer drive means.

13. The ammunition transfer apparatus according to claim 12 wherein said extractor means further comprises cam means for causing radial movement of said plurality of dogs, said cam means including a protruding pawl and said housing means comprises means, defining a longitudinal slot wherein, for guiding said protruding pawl.

14. The ammunition transfer apparatus according to claim 13 further comprising case rider means, attached to the rammer drive means chain at a spaced apart distance from said extraction means, for maintaining alignment of an ammunition round being inserted into the gun within a gun chamber.

15. Ammunition transfer apparatus for movement of ammunition rounds from a magazine to a gun, the apparatus comprising:

transfer means for withdrawing ammunition rounds from said magazine, inverting withdrawn ammunition rounds end for end, and inserting inverted withdrawn ammunition rounds into said gun; and reciprocating drive means, disposed between said magazine and said gun, for alternately moving said transfer means into a first position for withdrawing ammunition rounds and a second position for inserting inverted withdrawn ammunition rounds.

16. The ammunition transfer apparatus according to claim 15 wherein said transfer means comprises a transfer unit and a carrier means attached to said reciprocating drive means, for causing pivoted movement of said transfer unit during movement of said transfer means between the first and second positions.

17. The ammunition transfer apparatus according to claim 16 wherein said transfer unit comprises a housing and rammer means disposed within said housing for reciprocal movement therein, for moving ammunition rounds into and out of said housing.

18. The ammunition transfer apparatus according to claim 17 wherein said rammer means includes extractor means for temporarily gripping an ammunition round base in order to withdraw the ammunition round from said magazine.

19. The ammunition transfer apparatus according to claim 18 wherein said extractor means comprises a plurality of dogs disposed for radial movement with respect to a longitudinal axis of said housing and means for causing radial movement of said plurality of dogs in response to linear movement of said rammer means within said housing.

20. The ammunition transfer apparatus according to claim 19 wherein said reciprocating drive means comprises chain means for moving the transfer unit in reciprocating directions generally perpendicular to a longitudinal axis of said gun.

21. The ammunition transfer apparatus according to claim 20 wherein said carrier means includes an elevation frame engaging said chain means and said transfer unit.

22. The ammunition transfer apparatus according to claim 21 wherein said elevation frame includes pivot motor means for rotating said transfer unit during movement from the first to the second position.

23. The ammunition transfer apparatus according to claim 22 further comprising rammer drive means, disposed in the transfer unit housing, for reciprocating said rammer means within the housing.

24. The ammunition transfer apparatus according to claim 23 wherein said rammer drive means comprises at least one sprocket disposed at proximate ends of the housing and a chain interlinking opposing sprockets.

25. The ammunition transfer apparatus according to claim 24 wherein said extractor means comprise cam means for causing radial movement of said plurality of dogs, said cam means including a pawl and said housing comprises means, defining a longitudinal slot therein, for guiding said pawl.

26. The ammunition transfer apparatus according to claim 25 further comprises case rider means, attached to the rammer drive means chain at a spaced apart distance from said extractor means, for maintaining alignment of an ammunition round being inserted into the gun within a gun chamber.

* * * * *